US011476039B2

(12) United States Patent
Uematsu et al.

(10) Patent No.: US 11,476,039 B2
(45) Date of Patent: Oct. 18, 2022

(54) SURFACE MOUNT INDUCTOR AND MANUFACTURING METHOD THEREFOR

(71) Applicant: Murata Manufacturing Co., Ltd., Kyoto-fu (JP)

(72) Inventors: Ryuta Uematsu, Nagaokakyo (JP); Takumi Arai, Nagaokakyo (JP); Koichi Saito, Nagaokakyo (JP); Kazuhide Kudo, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 791 days.

(21) Appl. No.: 16/289,234

(22) Filed: Feb. 28, 2019

(65) Prior Publication Data

US 2019/0272947 A1 Sep. 5, 2019

(30) Foreign Application Priority Data

Mar. 1, 2018 (JP) ..... JP2018-036925

(51) Int. Cl.
*H01F 27/28* (2006.01)
*H01F 27/29* (2006.01)
(Continued)

(52) U.S. Cl.
CPC ..... *H01F 27/292* (2013.01); *H01F 17/06* (2013.01); *H01F 27/24* (2013.01); *H01F 27/28* (2013.01);
(Continued)

(58) Field of Classification Search
USPC ..... 336/192, 198, 232, 200
See application file for complete search history.

(56) References Cited

U.S. PATENT DOCUMENTS 10,304,613 B2 5/2019 Yoshizawa et al.
2007/0159282 A1* 7/2007 Huang ..... H01F 27/292 336/83
(Continued)

FOREIGN PATENT DOCUMENTS

CN 101896982 A 11/2010
JP S62-134201 U 8/1987
(Continued)

OTHER PUBLICATIONS

An Office Action issued by the Japanese Patent Office dated Sep. 21, 2021, which corresponds to Japanese Patent Application No. 2018-036925 and is related to U.S. Appl. No. 16/289,234 with English language translation.
(Continued)

*Primary Examiner* — Shawki S Ismail
*Assistant Examiner* — Kazi S Hossain
(74) *Attorney, Agent, or Firm* — Studebaker & Brackett PC

(57) ABSTRACT

A surface mount inductor includes a molded body made of a composite material containing a magnetic powder, and a metal plate including a first metal plate portion that is buried in the molded body and second metal plate portions that extend from the first metal plate portion to outside the molded body. The second metal plate portions each include a first bent portion that extends from a side surface of the molded body and is bent in a direction that intersects the mounting surface and a second bent portion that is bent from the direction that intersects the mounting surface toward a side surface the molded body. The second metal plate portions extend along the molded body onto the mounting surface and form an external terminal. An internal angle of each first bent portion is formed so as to be an obtuse angle.

15 Claims, 6 Drawing Sheets

(51) Int. Cl.

| | |
|---|---|
| ***H01F 27/24*** | (2006.01) |
| ***H01F 41/04*** | (2006.01) |
| ***H01F 41/02*** | (2006.01) |
| ***H01F 17/06*** | (2006.01) |
| *H01F 17/04* | (2006.01) |

(52) U.S. Cl.
CPC ..... *H01F 27/2847* (2013.01); *H01F 41/0246* (2013.01); *H01F 41/04* (2013.01); *H01F 2017/048* (2013.01)

(56) References Cited

U.S. PATENT DOCUMENTS

| | | | | |
|---|---|---|---|---|
| 2008/0012674 | A1* | 1/2008 | Sano | H01F 17/06 336/83 |
| 2009/0231077 | A1* | 9/2009 | Liao | H01F 17/04 29/606 |
| 2010/0253463 | A1 | 10/2010 | Shimomura et al. | |

FOREIGN PATENT DOCUMENTS

| | | | | |
|---|---|---|---|---|
| JP | 01135727 | U | * | 9/1989 |
| JP | H01-135727 | U | | 9/1989 |
| JP | H04-137008 | U | | 12/1992 |
| JP | 2000-040623 | A | | 2/2000 |
| JP | 2000-195753 | A | | 7/2000 |
| JP | 2004-153068 | A | | 5/2004 |
| JP | 2004153068 | A | * | 5/2004 |
| JP | 2014-150093 | A | | 8/2014 |
| JP | 2018-022729 | A | | 2/2018 |
| WO | 2009/075110 | A1 | | 6/2009 |

OTHER PUBLICATIONS

An Office Action; "Decision of Refusal," mailed by the Japanese Patent Office dated Sep. 21, 2021, which corresponds to Japanese Patent Application No. 2018-036925 and is related to U.S. Appl. No. 16/289,234 with English language translation.

An Office Action; "Notice of Reasons for Refusal," mailed by the Japanese Patent Office dated Mar. 9, 2021, which corresponds to Japanese Patent Application No. 2018-036925 and is related to U.S. Appl. No. 16/289,234; with English language translation.

An Office Action; "Notice of Reasons for Refusal," mailed by the Japanese Patent Office dated Sep. 8, 2020, which corresponds to Japanese Patent Application No. 2018-036925 and is related to U.S. Appl. No. 16/289,234 with English language translation.

* cited by examiner

SURFACE MOUNT INDUCTOR AND MANUFACTURING METHOD THEREFOR

CROSS-REFERENCE TO RELATED APPLICATION

This application claims benefit of priority to Japanese Patent Application No. 2018-036925, filed Mar. 1, 2018, the entire content of which is incorporated herein by reference.

BACKGROUND

Technical Field

The present disclosure relates to a surface mount inductor and a manufacturing method therefor.

Background Art

A coil component is known in which a terminal that is connected to a coil extends from a body in which the coil and portion of the terminal are accommodated and is bent so as to extend along the body as described, for example, in Japanese Unexamined Patent Application Publication No. 2014-150093. In this coil component, one end of the terminal is bent so as to extend along an inner wall of a recess provided in the bottom surface of the body and the terminal is locked to the bottom surface of the body, and as a result breaking of the terminal due to vibrations can be prevented.

In the above-described coil component of the related art, an element body that will accommodate the coil is molded, and then a metal plate that extends outside the body is bent so as to form an external terminal. Therefore, if the coil component is reduced in size, the body may be damaged when bending the metal plate.

SUMMARY

The present disclosure provides a surface mount inductor and a manufacturing method therefor in which damage to a molded body when forming an external terminal is suppressed.

A surface mount inductor of a preferred embodiment of the disclosure of the present disclosure includes a molded body made of a composite material containing magnetic powder; and a metal plate including a first metal plate portion that is buried in the molded body and second metal plate portions that extend from the first metal plate portion to outside the molded body. The second metal plate portions extend from side surfaces of the molded body and each include a first bent portion that is bent from a direction in which the second metal plate portion extends from the molded body to a direction that intersects a mounting surface and a second bent portion that is bent from the direction that intersects the mounting surface toward the side surface of the molded body. The second metal plate portions extend along the molded body onto the mounting surface side and form an external terminal. An internal angle of each first bent portion is formed as an obtuse angle.

A surface mount inductor manufacturing method of a preferred embodiment of the present disclosure includes arranging a metal plate having a first metal plate portion, which extends in a length direction, and second metal plate portions, which are continuous with both ends of the first metal plate portion, in a mold; filling the inside of the mold with a composite material containing a magnetic powder so as to cover the first metal plate portion; pressurizing the composite material and obtaining a molded body in which the second metal plate portions are exposed and the first metal plate portion is buried; and forming first bent portions, internal angles of which are obtuse angles, at portions of the second metal plate portions that extend from the molded body so as to form an external terminal.

According to the preferred embodiments of the present disclosure, there can be provided a surface mount inductor and a manufacturing method therefor in which damage to a molded body is suppressed when forming an external terminal.

Other features, elements, characteristics and advantages of the present disclosure will become more apparent from the following detailed description of preferred embodiments of the present disclosure with reference to the attached drawings.

DETAILED DESCRIPTION

Figure 1A:
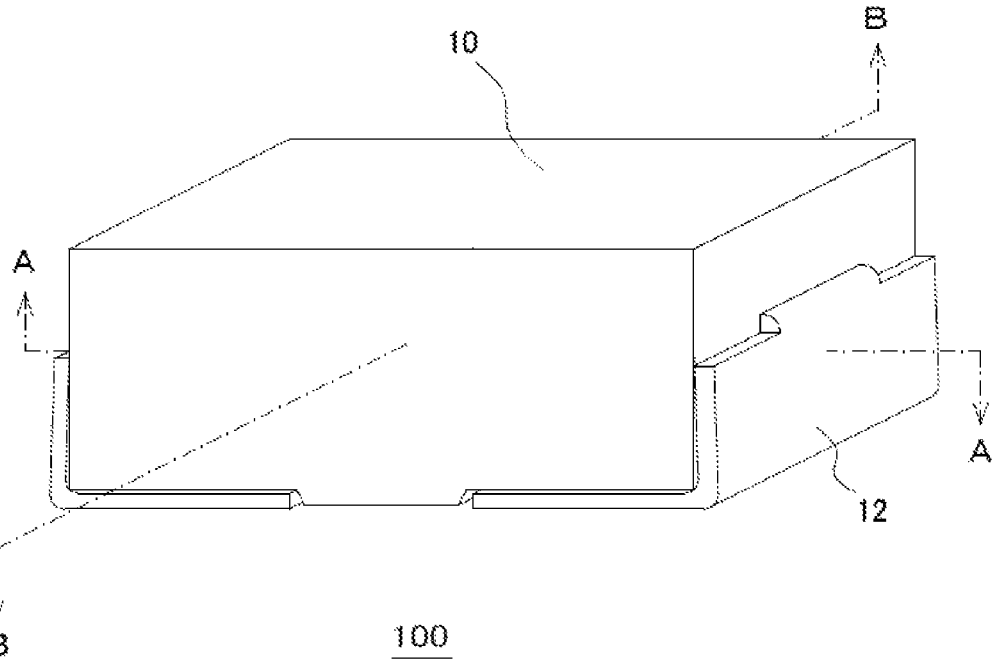
FIG. 1A is a perspective view illustrating an example of a surface mount inductor of a first embodiment.

A surface mount inductor includes a molded body made of a composite material containing a magnetic powder; and a metal plate including a first metal plate portion that is buried in the molded body such that a surface thereof that is perpendicular to a thickness direction is parallel to a mounting surface of the molded body and second metal plate portions that extend from the first metal plate portion to outside the molded body. The second metal plate portions extend from side surfaces of the molded body and each include a first bent portion that is bent from a direction in which the second metal plate portion extends from the molded body to a direction that intersects the mounting surface of the molded body and a second bent portion that is bent from the direction that intersects the mounting surface of the molded body toward the side surface of the molded body. The second metal plate portions extend along the molded body to the mounting surface and form an external terminal. An internal angle of each first bent portion is formed as an obtuse angle.

In this surface mount inductor, since the internal angles of the first bent portions are formed as obtuse angles at the positions where the second metal plate portions extend from the molded body, the stress acting on the molded body when the metal plate is bent to form the first bent portions is relaxed and damage to the molded body is suppressed. In addition, in the surface mount inductor, the second metal plate portions extend from side surfaces of the molded body, and therefore the length of the metal plate portions forming the external terminal can be increased and stress acting on the molded body when bending the metal plate can be relaxed.

Internal angles of the second bent portions may be formed as obtuse angles. In this way, the load acting on the external terminal can be reduced.

Both end portions of the external terminal may be arranged so as to be parallel to the mounting surface. Thus, mountability is further improved.

The width of each first bent portion may be smaller than the width of the external terminal. In this way, the force required when forming the first bent portions by bending the metal plate is reduced and the stress acting on the molded body is further relaxed.

The molded body may have a recess on the mounting surface side thereof that accommodates the external terminal. In this way, the mountability is further improved, and the strength with which the external terminal is affixed to the molded body is further improved.

A surface mount inductor manufacturing method includes an arrangement step of arranging a metal plate having a first metal plate portion, which extends in a length direction, and second metal plate portions, which are continuous with both ends of the first metal plate portion, in a mold; a filling step of filling the inside of the mold with a composite material including a magnetic powder so as to cover the first metal plate portion; a pressurizing step of pressurizing the composite material to obtain a molded body in which the second metal plate portions are exposed and the first metal plate portion is buried; and a bending step of forming first bent portions, internal angles of which are obtuse angles, at portions of the second metal plate portions that extend from the molded body so as to form an external terminal.

Since the internal angles of the first bent portions are formed as obtuse angles in this surface mount inductor manufacturing method, stress acting on the molded body when bending the metal plate is relaxed and damage to the molded body can be suppressed.

Regarding the metal plate arranged in the mold, the second metal plate portions may include side surface arrangement portions at both ends of the first metal plate portion, the second bent portions, which are bent in the same direction, at end portions of the side arrangement portions on the opposite side from the first metal plate portion, and mounting surface arrangement portions that extend from the second bent portions in a direction that intersects a direction in which the side surface arrangement portions extend. As a result, the number of times bending is performed after the pressurizing step is reduced and the stress load acting on the molded body is reduced.

The manufacturing method may further include, prior to forming the first bent portions, forming the second bent portions that are bent in the same direction which intersects a length direction of the metal plate at positions separated from portions of the second metal plate portions that extend from the molded body. In this way, the stress acting on the molded body when forming the second bent portions can be relaxed.

The term "step" used in this specification refers to not only an independent step but also a step that cannot be clearly distinguished from another step so long as the expected purpose of that step is achieved. Hereafter, embodiments of the disclosure of the present disclosure will be described on the basis of the drawings. The following embodiments are exemplary examples of a surface mount inductor for making the technical ideas of the present disclosure clear, and the present disclosure is not limited to the surface mount inductors described below. Members described in the scope of the claims are in no way limited to the members described in the embodiments. In particular, unless specifically stated otherwise, it is not intended that scope of the present disclosure be limited to the dimensions, materials, shapes, relative arrangements, and so forth of constituent components described in the embodiments and these are merely explanatory examples. In addition, the sizes of the members illustrated in the drawings, the positional relationships therebetween, and so forth may be exaggerated for the sake of clear explanation. In the following description, identical names and reference symbols are used to denote identical or similar members and detailed description of such members is omitted as appropriate. Furthermore, the elements of the present disclosure may also be implemented such that a plurality of elements are formed by the same member and a plurality of elements are shared by a single member, and conversely the function of one member may be shared by a plurality of members. In addition, content described in some examples can be utilized in other examples.

EMBODIMENTS

First Embodiments

Figure 1B:
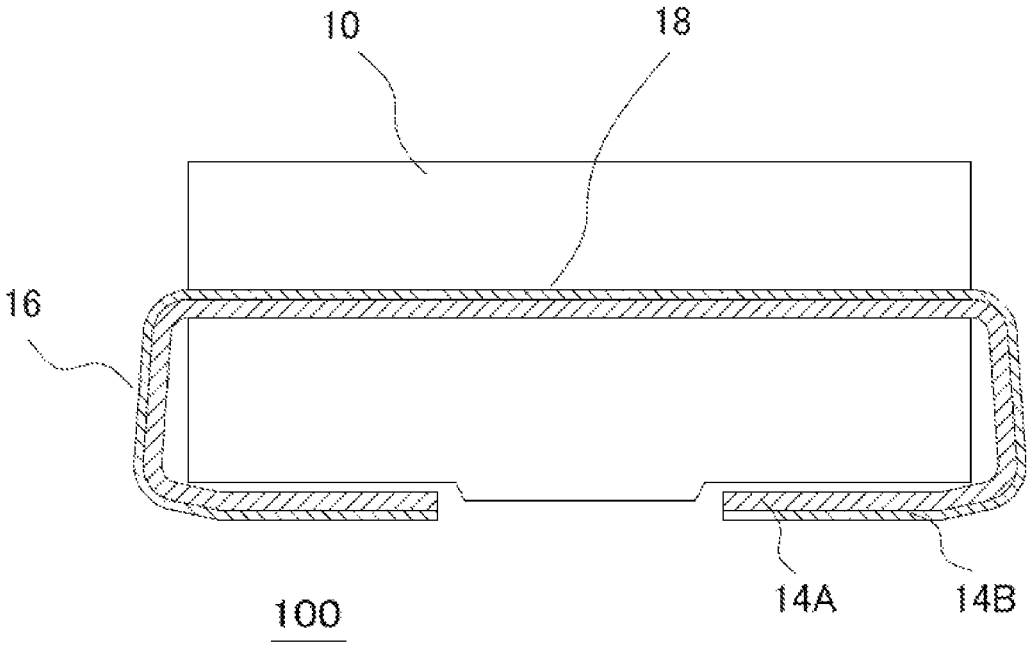
FIG. 1B is a cross-sectional view taken along line A-A in FIG. 1A.
Figure 1C:
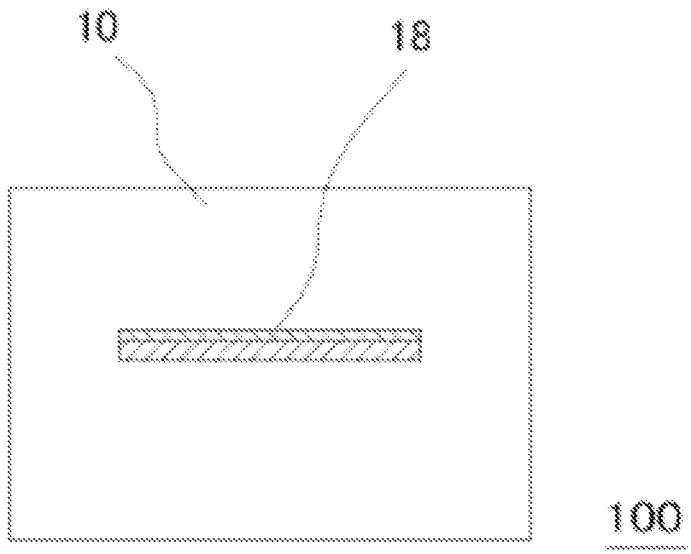
FIG. 1C is a cross-sectional view taken along line B-B in FIG. 1A.
Figure 1D:
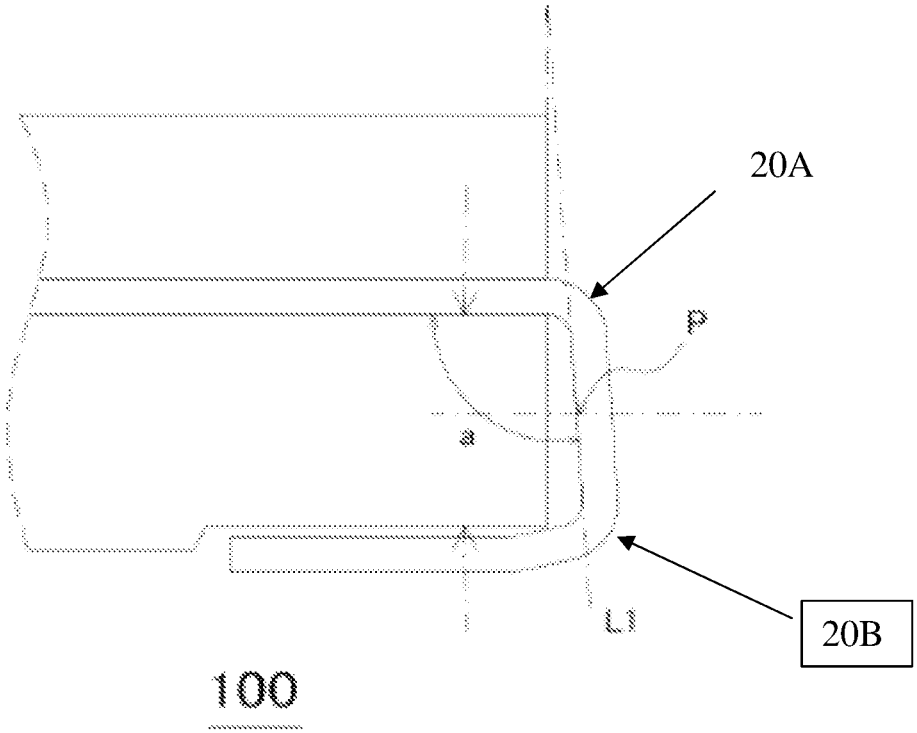
FIG. 1D is a partial enlarged view of FIG. 1B.

A surface mount inductor 100 of a first embodiment will be described while referring to FIGS. 1A to 1D. FIG. 1A is a schematic perspective view of the surface mount inductor 100 according to the first embodiment. FIG. 1B is a schematic cross-sectional view taken along line A-A in FIG. 1A. FIG. 1C is a schematic cross-sectional view taken along line B-B in FIG. 1A. FIG. 1D is a partial enlarged view of FIG. 1B.

As illustrated in FIG. 1A, the surface mount inductor 100 according to the first embodiment includes a molded body 10 made of a composite material containing magnetic powder and an external terminal 12 that is formed of a metal plate that is buried inside the molded body 10. The molded body 10 has a bottom surface that is on the mounting surface side, an upper surface that faces the bottom surface, and four side surfaces that are substantially perpendicular to the bottom surface and the upper surface. In addition, the molded body 10 has a longitudinal direction that is parallel to the direction of a line A-A and a lateral direction that is parallel to the direction of a line B-B. The external terminal 12 extends from the side surfaces of the molded body 10 in the longitudinal direction, has bent portions, and extends along the side surfaces of the molded body 10 onto the bottom surface. The external terminal 12 is formed of second metal plate portions that are formed so as to be continuous with a first metal plate portion that is buried in the molded body 10. The external terminal 12 has a width that is larger than the width of portions that extend from the molded body 10, and has substantially the same width as the molded body 10 in a lateral direction. In other words, the widths of first bent portions at the portions that extend from the molded body 10 are the same as that of the first metal plate portion but are smaller than the width of the external terminal 12. In addition, the internal angles of the first bent portions are formed as obtuse angles, and there are gaps between the portions of the external terminal 12 that are arranged along the side surfaces of the molded body 10 and the molded body 10. Furthermore, the leading end portions of the external terminal 12, which are arranged substantially parallel to the mounting surface at the bottom surface of the molded body 10, are parallel to the mounting surface. Recesses that accommodate the external terminal 12 are provided on the bottom surface of the molded body 10. The composite material constituting the molded body 10 may include a binder such as a resin in addition to the magnetic powder. Ferrite particles, or metal magnetic particles such as a metal magnetic material including iron, or an amorphous alloy, a nano crystal, and so on can be used as the magnetic powder. In addition, a thermally curable resin such an epoxy resin is used as the binder.

In FIG. 1A, the width of the external terminal is substantially the same as the width of the molded body in the lateral direction, but the width of the external terminal may be smaller than the width of the molded body in the lateral direction, and for example, may be the same width as the first metal plate portion buried in the molded body 10 or may be larger than the width of the first metal plate portion but smaller than the width of the molded body in the lateral direction.

As illustrated in FIG. 1B, the surface mount inductor 100 includes the molded body 10, and a metal plate that includes a first metal plate portion 18 that is buried in the molded body 10 and second metal plate portions 16 that extend from the first metal plate portion 18 to outside the molded body 10. The metal plate has a substantially straight shape including the second metal plate portions 16 on both sides of the first metal plate portion 18 in the direction in which the metal plate extends, and has an extension direction, a width direction that is perpendicular to the extension direction in a planar direction, and a thickness that is perpendicular to the extension direction and the width direction. Although not illustrated in FIG. 1B, the widths of the second metal plate portions 16 of the metal plate are larger than the width of the first metal plate portion 18 of the metal plate. The metal plate extends through the molded body 10, and the two end portions of the metal plate extend from the respective side surfaces of the molded body 10 as the second metal plate portions 16. The first metal plate portion 18 is buried in the molded body 10 and constitutes a coil conductor portion. The second metal plate portions 16 extend from the side surfaces of the molded body 10, each have two bent portions, extend along the side surfaces of the molded body 10 onto the bottom surface, and form an external terminal. First bent portions, which are located at positions where the second metal plate portions 16 extend from the molded body 10, are bent via internal angles, which are obtuse angles, toward the mounting surface. Furthermore, the portions of the second metal plate portions 16 that extend along the side surfaces are bent in a direction substantially parallel to the bottom surface of the molded body 10 at second bent portions on the bottom surface side of the molded body 10. The internal angles of the second bent portions may be acute angles, right angles, or obtuse angles. There are gaps between the side surfaces of the molded body 10 and the portions of the second metal plate portions 16 that extend along the side surfaces. In FIG. 1B, the portions of the second metal plate portions 16 that extend along the side surfaces of the molded body include straight portions, but these portions may instead have substantially curved shapes that are continuous from the first bent portions to the second bent portions. The portions of the second metal plate portions 16 that are arranged along the bottom surface of the molded body 10 are partially accommodated in recesses provided on the bottom surface. In FIG. 1B, there are gaps between portions of the bottom surfaces of the recesses of the molded body 10 and the portions of the second metal plate portions 16 that are arranged along the bottom surface of the molded body 10, but these portions may instead contact each other without the presence of the gaps.

The metal plate is formed so as to have a plating layer 14B on one surface of a conductive metal base material 14A, which is composed of copper or the like, for example. The second metal plate portions 16 are arranged such that the metal base material 14A of the metal plate faces the side surfaces and the bottom surface of the molded body 10, and the plating layer 14B is provided on the surface of the metal base material 14A on the opposite side from the molded body 10. As a result, the plating layer 14B is provided on the surfaces of the portions of the external terminal arranged on the mounting surface side on the opposite side from the surfaces that faces the molded body 10, and the plating layer 14B is not present on the surfaces that face the molded body 10 and the metal base material 14A instead faces the molded body 10. In addition, the plating layer 14B is also provided on the surface of the first metal plate portion 18, which is continuous with the surfaces of the second metal plate portions 16 on which the plating layer 14B is provided. Furthermore, recesses are provided on the bottom surface, which is on the mounting surface side, of the molded body 10, and the external terminal is partially accommodated therein. In addition, the surfaces of the external terminal on the mounting surface side protrude beyond the bottom surface of the molded body 10.

As illustrated in FIG. 1C, in a cross section of the surface mount inductor 100 taken along line B-B, the first metal plate portion 18 of the metal plate is buried in the molded body 10 and constitutes portion of a coil conductor. The first metal plate portion 18 is arranged such that the surfaces thereof that are perpendicular to the thickness direction are substantially parallel to the bottom surface and the upper surface of the molded body 10, and is arranged such that the side surfaces thereof in the thickness direction are separated from the side surfaces of the molded body 10. In addition, the plating layer 14B is provided on the surface of the first metal plate portion 18 on the opposite side from the mounting surface side of the first metal plate portion 18.

FIG. 1D is a partial enlarged sectional view for explaining the feature that the first bent portions each have an internal angle that is an obtuse angle. The angle of the bend of each first bent portion is defined as an internal angle a of the first bent portion. The internal angle a is formed between a straight line that extends along a surface, which faces the mounting surface, of the first metal plate portion that is buried in the molded body and a tangent L1 that is set at the side of a surface of the second metal plate portion that faces the side surface of the molded body in a cross section that is parallel to the longitudinal direction of the molded body 10 and is perpendicular to the upper surface and the bottom surface of the molded body 10 of the surface mount inductor 100. The tangent L1 is a tangent at a point P1 at which an extension, toward the second metal plate portion, of a plane that bisects the distance between a surface of the first metal plate portion that faces the bottom surface of the molded body and the bottom surface of the molded body, and a surface of the second metal plate portion that faces the side surface of the molded body intersect each other. Here, in the case where recesses that accommodate the second metal plate portions are provided on the bottom surface of the molded body, the bottom surfaces of the recesses are regarded as the bottom surface of the molded body. In FIG. 1D, the second metal plate portion has a straight portion and the point P1 lies on this straight portion, and therefore the tangent L1 is set so as to extend along this straight portion. Furthermore, the internal angle a is calculated as the sum of an internal angle formed between a straight line that extends along a surface of the first metal plate portion, which is buried in the molded body, that faces the mounting surface and the side surface of the molded body and an internal angle formed between the tangent L1 set at the side of the surface of the second metal plate portion that faces the side surface of the molded body and the side surface of the molded body or an extension line that extends along that side surface in the cross section of the surface mount inductor 100.

The molded body 10 is for example formed to have a size in which the length, which the dimension in the longitudinal direction, is 2.5 mm, the width, which is the dimension in the lateral direction, is 2.0 mm, and the height, which is the distance between the bottom surface and the upper surface, is 1.0 mm, that is, so as to have a so-called 252010 size. Furthermore, for example, the metal plate consists of the metal base material 14A, which is composed of copper and has a thickness of 150 μm, and the plating layer 14B, which is formed over the entirety of one surface of the metal base material 14A. Regarding the line width of the metal plate, for example, the line width of the first metal plate portion can be 600 μm and the line width of the second metal plate portions can be 2000 μm. The plating layer of the metal plate, for example, is formed so as to include first layer nickel (Ni) plating, which is provided so as to contact the metal base material 14A, and second layer tin (Sn) plating, which is provided on the first layer.

In the surface mount inductor 100, the first bent portions of the second metal plate portions 16 are bent so as to have obtuse angles, and as a result, stress acting on the molded body 10 when manufacturing the surface mount inductor 100 is relaxed and damage to the molded body 10 can be suppressed. Furthermore, in the surface mount inductor 100, the widths of the first bent portions are smaller than the widths of the second metal plate portions 16, and therefore the force applied when forming the first bent portions can be reduced and the stress acting on the molded body 10 is further relaxed. In addition, in the surface mount inductor 100, the lengths of the second metal plate portions 16 can be increased, and therefore the stress acting on the molded body when forming the external terminal by bending the second metal plate portions 16 is further relaxed.

Second Embodiment

Figure 2A:
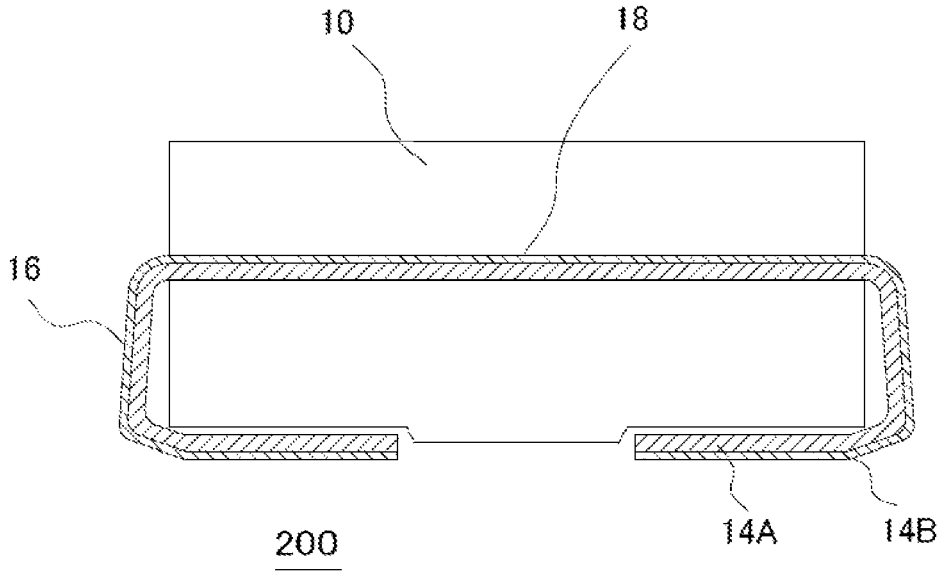
FIG. 2A is a cross-sectional view illustrating an example of a surface mount inductor of second embodiment.
Figure 2B:
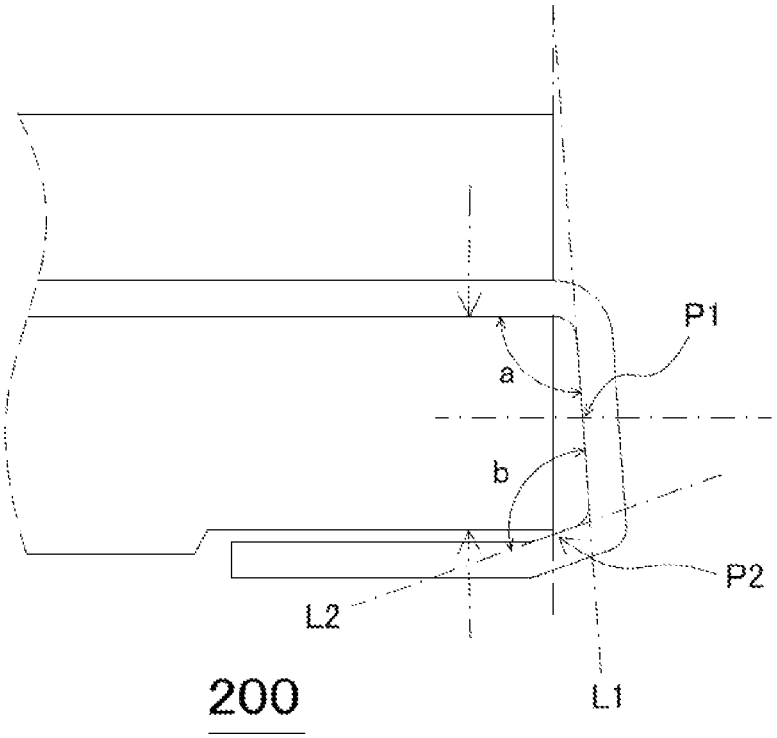
FIG. 2B is a partial enlarged view of FIG. 2A.

A surface mount inductor 200 according to a second embodiment will be described while referring to FIGS. 2A and 2B. FIG. 2A is an schematic cross-sectional view of the surface mount inductor 200 according to second embodiment, which corresponds to FIG. 1B. FIG. 2B is a partial enlarged view of FIG. 2A. In the surface mount inductor 200 according to the second embodiment, internal angles of second bent portions between the portions of second metal plate portions 16 that extend along the side surfaces of a molded body 10 and a direction substantially parallel to the bottom surface of the molded body 10 are obtuse angles.

As illustrated in FIG. 2A, the surface mount inductor 200 includes the molded body 10, and a metal plate that includes a first metal plate portion 18 that is buried in the molded body 10 and the second metal plate portions 16 that extend from the first metal plate portion 18 to outside the molded body. In the surface mount inductor 200, the second metal plate portions 16 extend from the side surfaces of the molded body 10 in the longitudinal direction, each have at least two bent portions, extend along the side surfaces of the molded body 10 onto the bottom surface, and form an external terminal. First bent portions, which are located at positions where the second metal plate portions 16 extend from the molded body 10, are bent via internal angles, which are obtuse angles, toward the mounting surface. Furthermore, second bent portions, which are bent from portions of the second metal plate portions 16 that extend along the side surfaces of the molded body 10 in a direction substantially parallel to the bottom surface of the molded body 10, are bent with internal angles that are obtuse angles. In FIG. 2A, the second metal plate portions 16 have third bent portions located between the second bent portions and the end portions of the metal plate, the portions of the second metal plate portions 16 that are arranged on the bottom surface of the molded body 10 are substantially parallel to the bottom surface of the molded body 10.

In FIG. 2A, the portions of the second metal plate portions 16 that extend along the side surfaces of the molded body have straight portions between the first bent portions and the second bent portions and between the second bent portions and the third bent portions, but these portions may instead have substantially curved shapes that are continuous from the first bent portions to the second bent portions and may have substantially curved shapes that are continuous from the second bent portions to the third bent portions.

FIG. 2B is a partial enlarged sectional view for explaining the feature that the second bent portions each have an internal angle that is an obtuse angle. The angle of the bend of each second bent portion is defined as an internal angle b of the second bent portion. The internal angle b is formed between a tangent L1 that is set at the side of a surface of the second metal plate portion that faces the side surface of the molded body and a tangent L2 that is set at the side of a surface of the second metal plate portion that faces the side surface of the molded body in a cross section that is parallel to the longitudinal direction of the molded body 10 of the surface mount inductor 200 and is perpendicular to the upper surface and the bottom surface of the molded body 10. The tangent L1 is a tangent at a point P1 at which an extension, toward the second metal plate portion, of a plane that bisects the distance between a surface of the first metal plate portion that faces the bottom surface of the molded body and the bottom surface of the molded body, and a surface of the second metal plate portion that faces the side surface of the molded body intersect each other. Here, in the case where recesses that accommodate the second metal plate portions are provided on the bottom surface of the molded body, the bottom surfaces of the recesses are regarded as the bottom surface of the molded body. In FIG. 2B, the second metal plate portion has a straight portion and the point P1 lies on the straight portion, and therefore the tangent L1 is set so as to extend along this straight portion. In addition, the tangent L2 is a tangent at a point P2 at which an extension of the side surface of the molded body toward the second metal plate portion and a surface of the second metal plate portion that faces the molded body intersect each other. In FIG. 2B, the second metal plate portion has a straight portion and the point P2 lies on the straight portion, and therefore the tangent L2 is set so as to extend along this straight portion.

In the surface mount inductor 200, the second bent portions of the second metal plate portions 16 are bent via obtuse angles, and therefore the load acting on the first bent portions of the external terminal and the molded body can be reduced. In addition, in the surface mount inductor 200, the portions of the second metal plate portions arranged on the bottom surface of the molded body are arranged substantially parallel to the bottom surface, and therefore mountability is further improved.

Third Embodiment

Figure 3A:
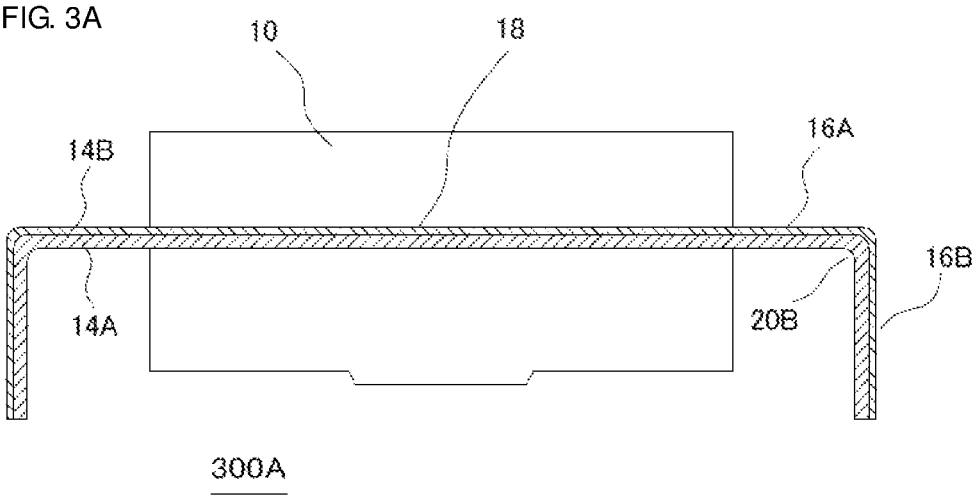
FIG. 3A is a cross-sectional view that conceptually illustrates an example of a method of manufacturing a surface mount inductor of a first embodiment.
Figure 3B:
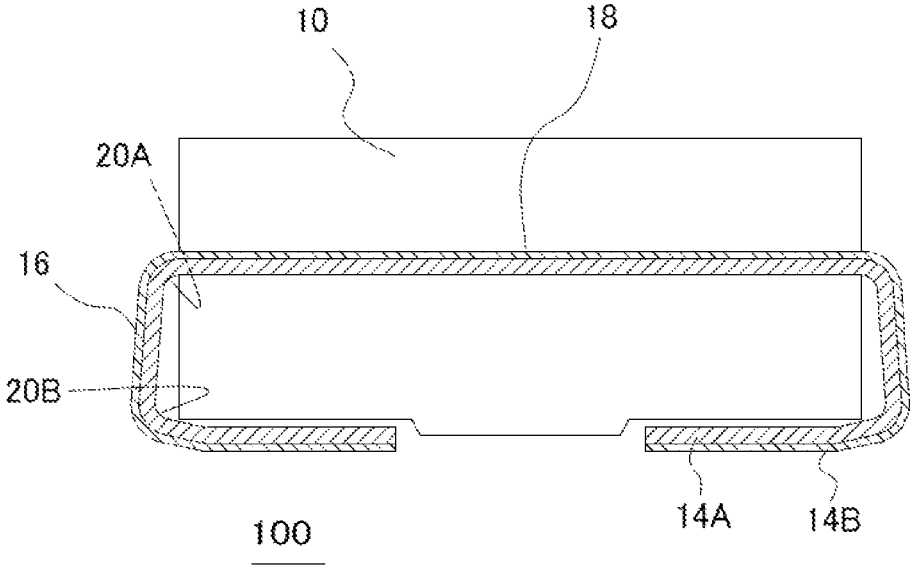
FIG. 3B is a cross-sectional view that conceptually illustrates an example of a method of manufacturing a surface mount inductor of a first embodiment.

A method of manufacturing the surface mount inductor 100 of first embodiment will be described while referring to FIGS. 3A and 3B. FIG. 3A is a partial cross-sectional view of a precursor 300A formed using a metal plate that has been provided with second bent portions 20B in advance. FIG. 3B is a partial cross-sectional view of the surface mount inductor 100 obtained by forming first bent portions 20A in the precursor 300A illustrated in FIG. 3A.

In FIG. 3A, the precursor 300A includes the molded body 10 and a metal plate which has the second bent portions 20B located between side surface arrangement portions 16A and mounting surface arrangement portions 16B. The metal plate is formed such that the second metal plate portions 16, which include the side surface arrangement portions 16A and the mounting surface arrangement portions 16B, are continuous with the two ends of the first metal plate portion 18. The width of the first metal plate portion 18 is formed so as to be smaller than the widths of the second metal plate portions 16 and the widths of the side surface arrangement portions 16A and the mounting surface arrangement portions 16B are formed so as to be substantially the same as each other (not illustrated). In the precursor 300A, the side surface arrangement portions 16A are parallel to the first metal plate portion 18 and the mounting surface arrangement portions 16B are bent toward the mounting surface at the second bent portions 20B. In FIG. 3A, the second bent portions 20B are formed such that the side surface arrangement portions 16A and the mounting surface arrangement portions 16B are perpendicular to each other. In another mode, the internal angles of the second bent portions 20B may be formed as obtuse angles. The metal plate is formed so as to have a plating layer 14B on one surface of a conductive metal base material 14A, which is composed of copper or the like, for example.

The precursor 300A is obtained by arranging a metal plate, which is composed of the first metal plate portion 18 and the second metal plate portions 16 and in which the second bent portions 20B are formed in the second metal plate portions 16, in a mold, filling the inside of the mold with a composite material including a magnetic powder such that the first metal plate portion 18 is covered and the second metal plate portions 16 are exposed, and performing pressurization in the width direction of the metal plate so as to form the molded body 10 composed of the composite material. In the molded body 10, the second metal plate portions 16 are exposed outside the molded body 10 and the first metal plate portion 18 is buried inside the molded body 10. The metal plate is arranged such that the surface thereof having the plating layer 14B faces the upper surface of the molded body 10.

Next, the surface mount inductor 100 is obtained by forming the first bent portions 20A, the internal angles of which are obtuse angles, in the obtained precursor 300A. The first bent portions 20A are formed at portions of the second metal plate portions 16 that extend from the molded body 10. The first bent portions 20A are formed such that the internal angles thereof are obtuse angles, i.e., greater than 90° and less than 180°, and are for example formed so as to be greater than 90° and less than or equal to 110°. The first bent portions 20A are formed by applying a force to the side surface arrangement portions 16A in a direction toward the mounting surface. For example, after the first bent portions 20A have been bent to around 75° by applying a force toward the mounting surface to the side surface arrangement portions 16A, the mounting surface arrangement portions 16B may be arranged on the mounting surface by applying forces to the side surface arrangement portions 16A in directions in which the first metal plate portion 18 extends such that the forces are applied to the respective side surface arrangement portions 16A in opposite directions from each other. In addition, if necessary, third bent portions may be formed in the mounting surface arrangement portions 16B by applying a force toward the upper surface of the molded body 10 to the mounting surface arrangement portions 16B.

A metal plate in which the second bent portions 20B have been provided in advance is used in the method of manufacturing the surface mount inductor 100, and therefore the number of times bending is performed after forming the molded body 10 can be reduced and the stress applied to the molded body 10 can be relaxed. In addition, the stress applied to the molded body 10 can be further relaxed as a result of the first bent portions 20A being formed using two steps in the method of manufacturing the surface mount inductor 100.

Fourth Embodiment

Figure 4A:
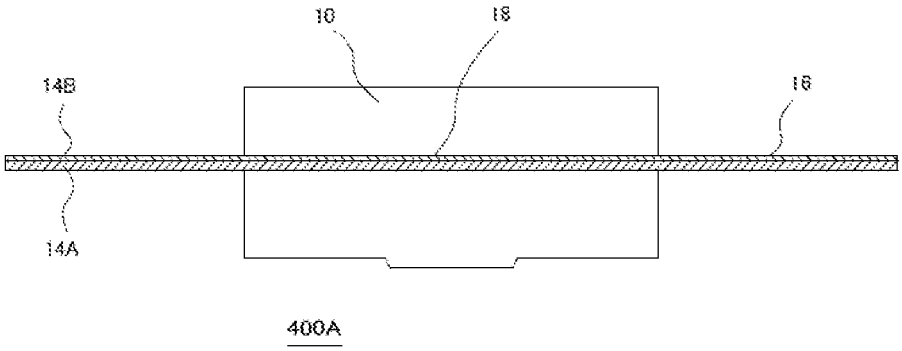
FIG. 4A is a cross-sectional view that conceptually illustrates an example of a method of manufacturing a surface mount inductor of second embodiment.
Figure 4B:
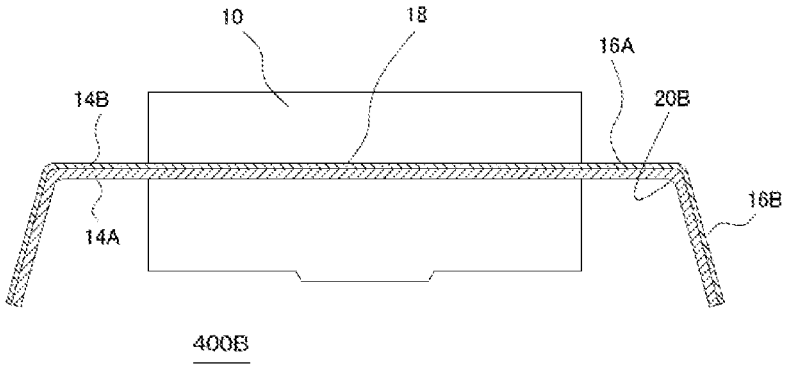
FIG. 4B is a cross-sectional view that conceptually illustrates an example of a method of manufacturing a surface mount inductor of second embodiment.
Figure 4C:
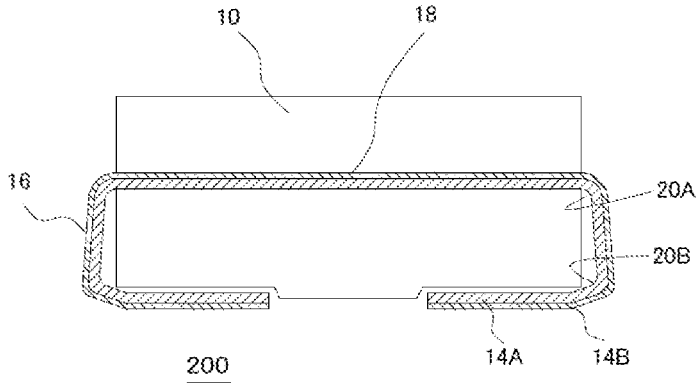
FIG. 4C is a cross-sectional view that conceptually illustrates an example of a method of manufacturing a surface mount inductor of second embodiment.

A method of manufacturing the surface mount inductor 200 of second embodiment will be described while referring to FIGS. 4A to 4C. FIG. 4A is a partial cross-sectional view of a first precursor 400A formed using a straight metal plate. FIG. 4B is a partial cross-sectional view of a second precursor 400B obtained by forming the second bent portions 20B in the first precursor 400A illustrated in FIG. 4A. FIG. 4C is a partial cross-sectional view of the surface mount inductor 200 obtained by forming the first bent portions 20A in the second precursor 400B illustrated in FIG. 4B.

In FIG. 4A, the first precursor 400A includes the molded body 10, and a metal plate that includes the first metal plate portion 18 that is buried in the molded body 10 and the second metal plate portions 16 that extend to outside the molded body 10. The metal plate is formed such that the second metal plate portions 16 are continuous with both ends of the first metal plate portion 18. The width of the first metal plate portion 18 is formed so as to be smaller than the width of the second metal plate portions 16 and the width of the second metal plate portions 16 and the width of the molded body 10 in the lateral direction are formed so as to be substantially the same as each other (not illustrated).

The first precursor 400A is obtained by arranging a straight metal plate, which is composed of the first metal plate portion 18 and the second metal plate portions 16, in a mold, filling the inside of the mold with a composite material including a magnetic powder such that the first metal plate portion 18 is covered and the second metal plate portions 16 are exposed, and performing pressurization in the width direction of the metal plate so as to form the molded body 10 composed of the composite material. In the molded body 10, the second metal plate portions 16 are exposed outside the molded body 10 and the first metal plate portion 18 is buried inside the molded body 10. The metal plate is formed so as to have a plating layer 14B on one surface of a conductive metal base material 14A, which is composed of copper or the like, for example. In addition, the metal plate is arranged such that the surface thereof having the plating layer 14B faces the upper surface of the molded body 10.

Next, the second precursor 400B is obtained by forming the second bent portions 20B, the internal angles of which are obtuse angles, in the obtained first precursor 400A. The second bent portions 20B are formed at positions in the second metal plate portions 16 that are separated from the side surfaces of the molded body 10, and the side surface arrangement portions 16A, the second bent portions 20B, and the mounting surface arrangement portions 16B are formed in the second metal plate portions 16 in a continuous manner from the first metal plate portion 18. The mounting surface arrangement portions 16B extend toward the mounting surface from the second bent portions 20B. The second bent portions 20B are formed such that the internal angles thereof are obtuse angles, i.e., greater than 90° and less than 180°, and are for example formed so as to be greater than 90° and less than or equal to 110°. In FIG. 4B, the internal angles of the second bent portions 20B are formed as obtuse angles, but in another mode, the second bent portions 20B may be formed as right angles. In other words, the side surface arrangement portions 16A and the mounting surface arrangement portions 16B may be perpendicular to each other. The second bent portions 20B are formed by applying a force in a direction toward the mounting surface to the end portions of the second metal plate portions 16.

Next, the surface mount inductor 200 is obtained by forming the first bent portions 20A, the internal angles of which are obtuse angles, in the obtained second precursor 400B. The first bent portions 20A are formed at portions of the second metal plate portions 16 that extend from the molded body 10. The first bent portions 20A are formed such that the internal angles thereof are obtuse angles, i.e., greater than 90° and less than 180°, and are for example formed so as to be greater than 90° and less than or equal to 110°. The first bent portions 20A are formed by applying a force to the side surface arrangement portions 16A in a direction perpendicular to the mounting surface. For example, after the first bent portions 20A have been bent to around 75° by applying a force in a direction perpendicular to the mounting surface to the side surface arrangement portions 16A, the mounting surface arrangement portions 16B may be arranged on the mounting surface by applying forces to the side surface arrangement portions 16A in directions in which the first metal plate portion 18 extends such that the forces are applied to the respective side surface arrangement portions 16A in opposite directions from each other. In addition, if necessary, third bent portions may be formed in the mounting surface arrangement portions 16B by applying a force toward the upper surface of the molded body 10 to the mounting surface arrangement portions 16B.

A straight metal plate is used in the method of manufacturing the surface mount inductor 200, and therefore manufacturability can be improved by integrating the metal plate with a frame such that a plurality of molded bodies can be formed in one go. In addition, the second bent portions are provided at positions that are separated from the side surfaces of the molded body in the method of manufacturing the surface mount inductor 200, and therefore the stress applied to the molded body 10 when forming the second bent portions can be relaxed.

Fifth Embodiment

Figure 5:
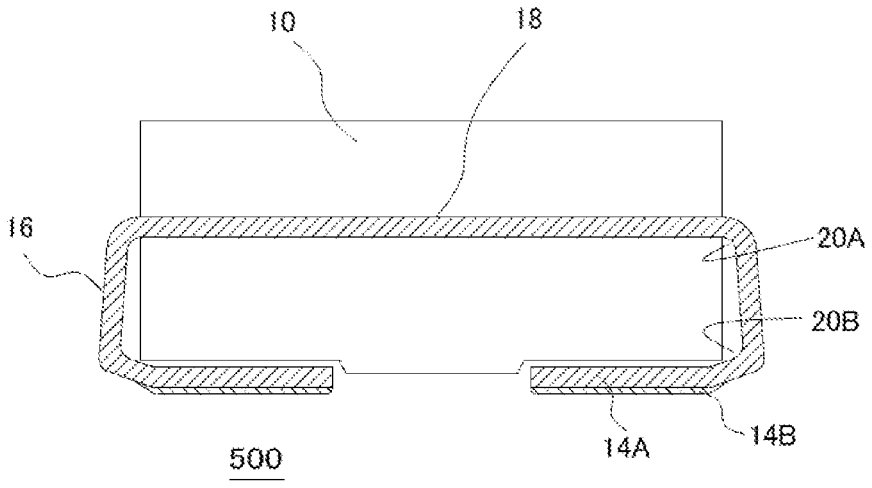
FIG. 5 is a cross-sectional view illustrating another example of a surface mount inductor.

A surface mount inductor 500 of fifth embodiment will be described while referring to FIG. 5. FIG. 5 is a partial cross-sectional view of the surface mount inductor 500, which corresponds to FIG. 1B. In the surface mount inductor 500, the plating layer 14B is formed on the mounting surface side of the external terminal after forming the external terminal using a metal plate 14A, which does not have a plating layer, as the metal plate in the surface mount inductor 200 of second embodiment.

In the surface mount inductor 500, the plating layer is provided only on the mounting surface side of the external terminal, and therefore the amount of plating material used can be reduced while maintaining excellent mountability.

Sixth Embodiment

Figure 6:
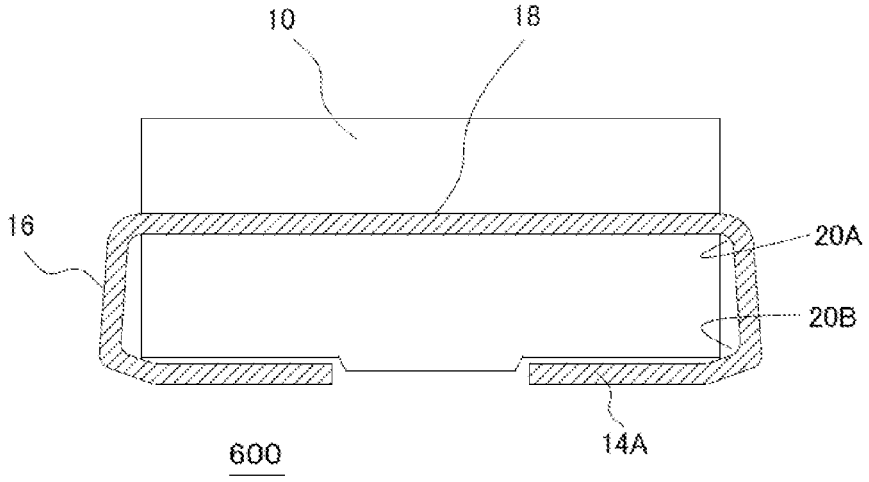
FIG. 6 is a cross-sectional view illustrating yet another example of a surface mount inductor.

A surface mount inductor 600 of sixth embodiment will be described while referring to FIG. 6. FIG. 6 is a partial cross-sectional view of the surface mount inductor 600 and corresponds to FIG. 1B. The surface mount inductor 600 is formed by using a metal plate 14A, which does not have a plating layer, as the metal plate in the surface mount inductor 200 of second embodiment.

A plating layer is not provided on the external terminal in the surface mount inductor 600, and therefore a surface mount inductor can be formed without using a plating material.

In the above-described surface mount inductors, the first metal plate portion has a substantially straight shape and forms portion of a coil conductor, but the first metal plate portion may instead have a substantially coil-like shape that is bent in the width direction. In addition, the leading end portions of the second metal plate portions may be arranged on a planar bottom surface without providing recesses for accommodating the second metal plate portions on the bottom surface of the molded body.

In addition, the third bent portions may be omitted.

Furthermore, the size of the molded body, the size of the metal plate, and so on can be changed as appropriate in accordance with the characteristics of the inductor.

In addition, in example 5, the plating layer formed on the mounting surface side of the external terminal may be provided so as to extend up to the first bent portions.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A surface mount inductor comprising:

a molded body made of a composite material containing magnetic powder; and a metal plate including a first metal plate portion that is buried in the molded body and second metal plate portions that extend from the first metal plate portion to outside the molded body;

wherein the second metal plate portions extend from side surfaces of the molded body and each include a first bent portion that is bent from a direction in which the second metal plate portion extends from the molded body to a direction that intersects a mounting surface and a second bent portion that is bent from the direction that intersects the mounting surface toward a side surface of the molded body, and the second metal plate portions extend along the molded body onto the mounting surface side and form an external terminal, an internal angle of each first bent portion is an obtuse angle, and a width of the first bent portions is smaller than a width of the external terminal.

2. The surface mount inductor according to claim 1, wherein internal angles of the second bent portions are obtuse angles.

3. The surface mount inductor according to claim 1, wherein the external terminal is arranged such that end portions thereof are parallel to the mounting surface.

4. The surface mount inductor according to claim 1, wherein the molded body has a recess in a mounting surface side thereof that accommodates the external terminal.

5. The surface mount inductor according to claim 2, wherein the external terminal is arranged such that end portions thereof are parallel to the mounting surface.

6. The surface mount inductor according to claim 2, wherein a width of the first bent portions is smaller than a width of the external terminal.

7. The surface mount inductor according to claim 3, wherein a width of the first bent portions is smaller than a width of the external terminal.

8. The surface mount inductor according to claim 5, wherein a width of the first bent portions is smaller than a width of the external terminal.

9. The surface mount inductor according to claim 2, wherein the molded body has a recess in a mounting surface side thereof that accommodates the external terminal.

10. The surface mount inductor according to claim 3, wherein the molded body has a recess in a mounting surface side thereof that accommodates the external terminal.

11. The surface mount inductor according to claim 5, wherein the molded body has a recess in a mounting surface side thereof that accommodates the external terminal.

12. The surface mount inductor according to claim 6, wherein the molded body has a recess in a mounting surface side thereof that accommodates the external terminal.

13. The surface mount inductor according to claim 7, wherein the molded body has a recess in a mounting surface side thereof that accommodates the external terminal.

14. The surface mount inductor according to claim 8, wherein the molded body has a recess in a mounting surface side thereof that accommodates the external terminal.

15. The surface mount inductor according to claim 1, wherein the plating layer is formed on the second metal plate after the second bending portion.

* * * * *